US009480378B2

(12) United States Patent
Paliobeis

(10) Patent No.: US 9,480,378 B2
(45) Date of Patent: Nov. 1, 2016

(54) PIVOTING HANDLE FOR A SURFACE CLEANING DEVICE

(71) Applicant: Techtronic Floor Care Technology Limited, Road Town, Tortola (VG)
(72) Inventor: Steven J. Paliobeis, Mentor, OH (US)
(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 14/846,024

(22) Filed: Sep. 4, 2015

(65) Prior Publication Data

US 2015/0374189 A1 Dec. 31, 2015

Related U.S. Application Data

(63) Continuation of application No. 13/559,896, filed on Jul. 27, 2012, now Pat. No. 9,125,538.

(51) Int. Cl.
*A47L 9/32* (2006.01)

(52) U.S. Cl.
CPC ..... *A47L 9/325* (2013.01)

(58) Field of Classification Search
CPC ..... A47L 9/325; A47L 9/32; A47L 9/10; A47L 9/02; A47L 9/327; A47L 9/009; A47L 5/28
See application file for complete search history.

(56) References Cited

U.S. PATENT DOCUMENTS

| | | | | |
|---|---|---|---|---|
| 187,618 | A | 2/1877 | Gore et al. | |
| 2,244,102 | A | 6/1941 | Elder | |
| 3,758,914 | A | 9/1973 | Nupp et al. | |
| 4,670,937 | A | 6/1987 | Sumerau et al. | |
| 5,564,160 | A | 10/1996 | Luebbering | |
| 5,996,175 | A | 12/1999 | Fusco | |
| 6,098,244 | A | 8/2000 | Conrad et al. | |
| 6,101,672 | A | 8/2000 | Conrad et al. | |
| 6,779,229 | B2 | 8/2004 | Lee et al. | |
| 6,941,615 | B2 | 9/2005 | Shanor et al. | |
| 7,219,390 | B2 | 5/2007 | Johnson et al. | |
| 7,281,298 | B2 | 10/2007 | Joung et al. | |
| 7,350,266 | B2 | 4/2008 | Park et al. | |
| 7,383,609 | B2 | 6/2008 | Ji | |
| 7,584,522 | B1 | 9/2009 | Weeter et al. | |
| 7,681,279 | B2 | 3/2010 | Kelly | |
| 7,854,039 | B2 | 12/2010 | Lee et al. | |
| 8,813,297 | B2 * | 8/2014 | Rosenzweig | A47L 5/28 15/144.1 |
| 2005/0125944 | A1 | 6/2005 | Ji | |
| 2005/0210626 | A1 * | 9/2005 | Joung | A47L 9/325 15/410 |
| 2005/0210627 | A1 | 9/2005 | Luebbering et al. | |
| 2006/0156509 | A1 | 7/2006 | Luebbering et al. | |
| 2007/0022562 | A1 | 2/2007 | Hampton | |
| 2008/0022483 | A1 | 1/2008 | Potoroka | |
| 2009/0064449 | A1 | 3/2009 | Newton et al. | |
| 2011/0113589 | A1 | 5/2011 | Geither | |

FOREIGN PATENT DOCUMENTS

| | | |
|---|---|---|
| CN | 201271204 | 7/2009 |
| CN | 201759500 | 3/2011 |
| CN | 201855227 | 6/2011 |
| CN | 201899055 | 7/2011 |
| DE | 3435878 | 4/1986 |
| GB | 729807 | 5/1955 |
| GB | 771323 | 3/1957 |
| JP | 64032829 | 2/1989 |
| JP | 08084694 | 4/1996 |

OTHER PUBLICATIONS

Extended European Search Report for Application No. 13193051.3 dated Apr. 9, 2014 (10 pages).
Chinese Patent Office Action with English Translation for Application No. 2013105752306 dated Aug. 29, 2016 (17 pages).

* cited by examiner

*Primary Examiner* — Dung Van Nguyen
(74) *Attorney, Agent, or Firm* — Michael Best & Friedrich LLP

(57) ABSTRACT

A surface cleaning device generally includes a nozzle, a cleaner housing connected to the nozzle, and a handle coupled to the cleaner housing at a pivot joint. The cleaner housing defines a longitudinal axis. The pivot joint is configured to rotatably store the handle at a position offset from the longitudinal axis.

20 Claims, 8 Drawing Sheets

PIVOTING HANDLE FOR A SURFACE CLEANING DEVICE

CROSS-REFERENCE TO RELATED APPLICATIONS

This application is a continuation of and claims priority to U.S. Pat. No. 9,125,538, filed Jul. 27, 2012, the entire contents of which are herein incorporated by reference.

BACKGROUND

Vacuum cleaners typically include a suction nozzle, a cleaner housing connected to the suction nozzle, a suction generator in the cleaner housing, and a dirt collection vessel in the cleaner housing. In an upright-type vacuum cleaner, an elongate handle is coupled to the cleaner housing. The handle may be pivotable, so that the handle extends vertically for operating the vacuum and is rotated downwardly for storing or stowing.

SUMMARY

In one embodiment, a surface cleaning device generally includes a nozzle, a cleaner housing connected to the nozzle, and a handle coupled to the cleaner housing at a pivot joint. The cleaner housing defines a longitudinal axis. The pivot joint is configured to rotatably store the handle at a position offset from the longitudinal axis.

In another embodiment, a surface cleaning device generally includes a nozzle, a cleaner housing connected to the nozzle, and a handle coupled to the cleaner housing at a pivot joint. The cleaner housing defines a longitudinal axis. The pivot joint is configured to rotate the handle about a pivot axis that is non-perpendicular to the longitudinal axis.

In still another embodiment, a surface cleaning device generally includes a nozzle, a cleaner housing connected to the nozzle, and a handle coupled to the cleaner housing at a pivot joint. The cleaner housing defines a longitudinal axis. The pivot joint is configured to rotate the handle about a pivot axis, and to translate the handle in a direction along the pivot axis.

Other aspects of the invention will become apparent by consideration of the detailed description and accompanying drawings.

It should be understood that the invention is not limited in its application to the details of construction and the arrangements of the components set forth in the following description or illustrated in the above-described drawings. The invention is capable of other embodiments and of being practiced or being carried out in various ways. Also, it is to be understood that the phraseology and terminology used herein is for the purpose of description and should not be regarded as limiting.

DETAILED DESCRIPTION

Figure 1:
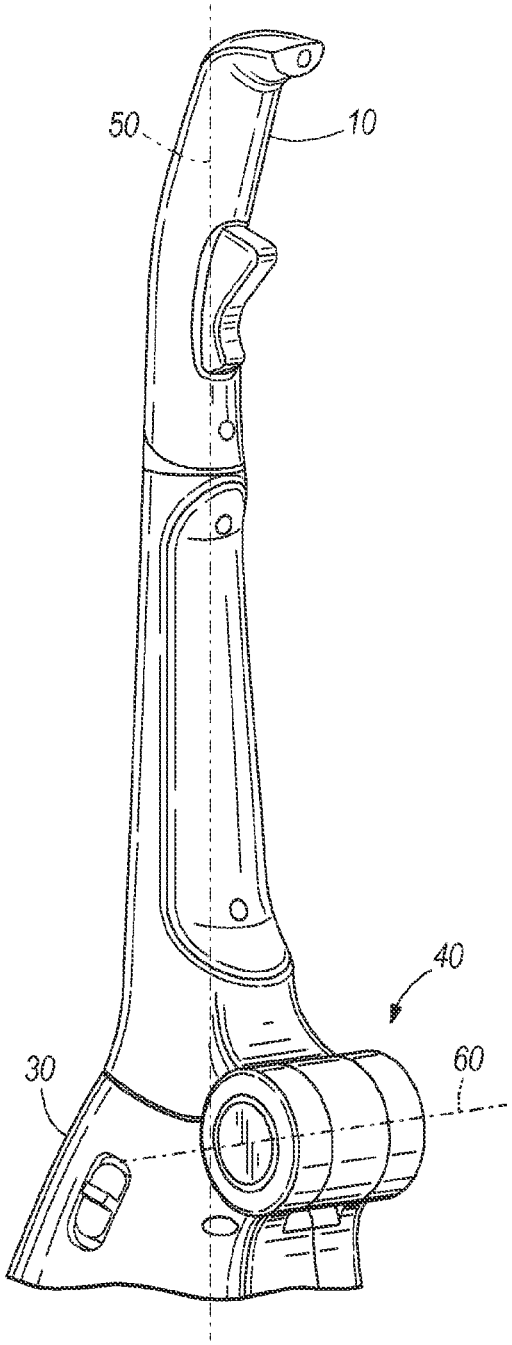
FIG. 1 PRIOR ART
FIG. 1 is an enlarged partial perspective view of a conventional handle for a vacuum cleaner.
Figure 2:
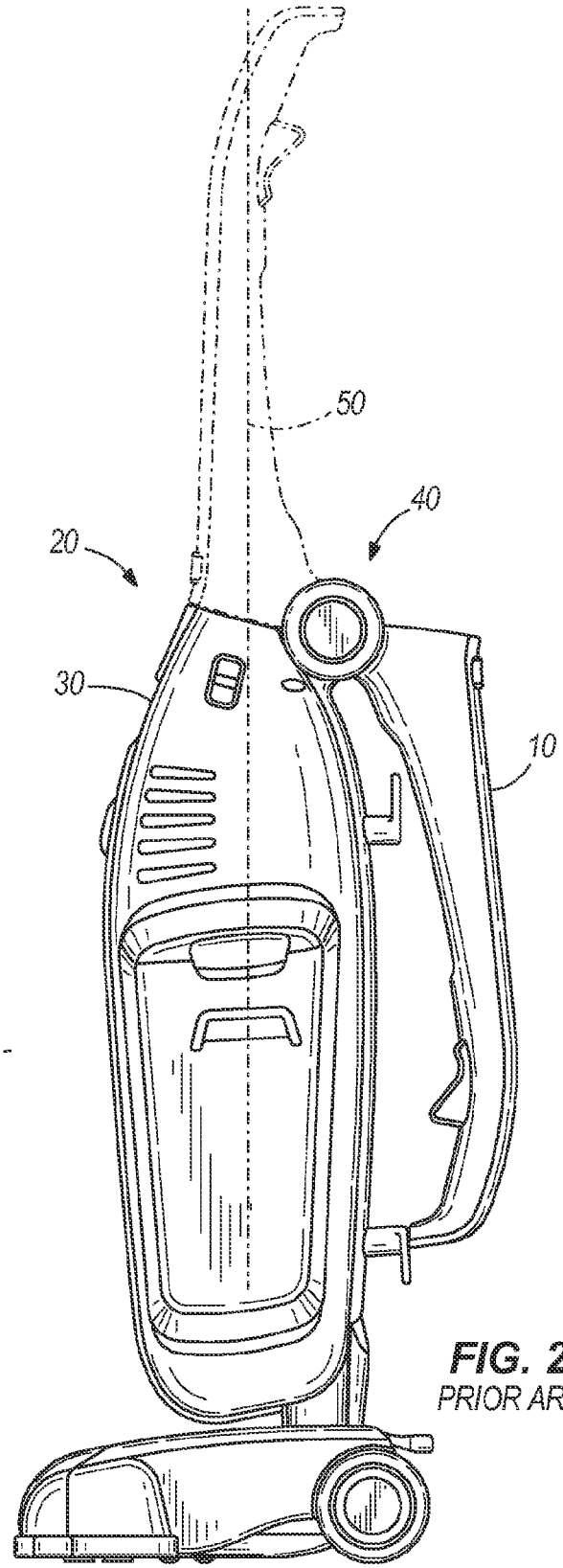
FIG. 2 PRIOR ART
FIG. 2 is a perspective view of the conventional handle of FIG. 1 rotated to a storage position.
Figure 3:
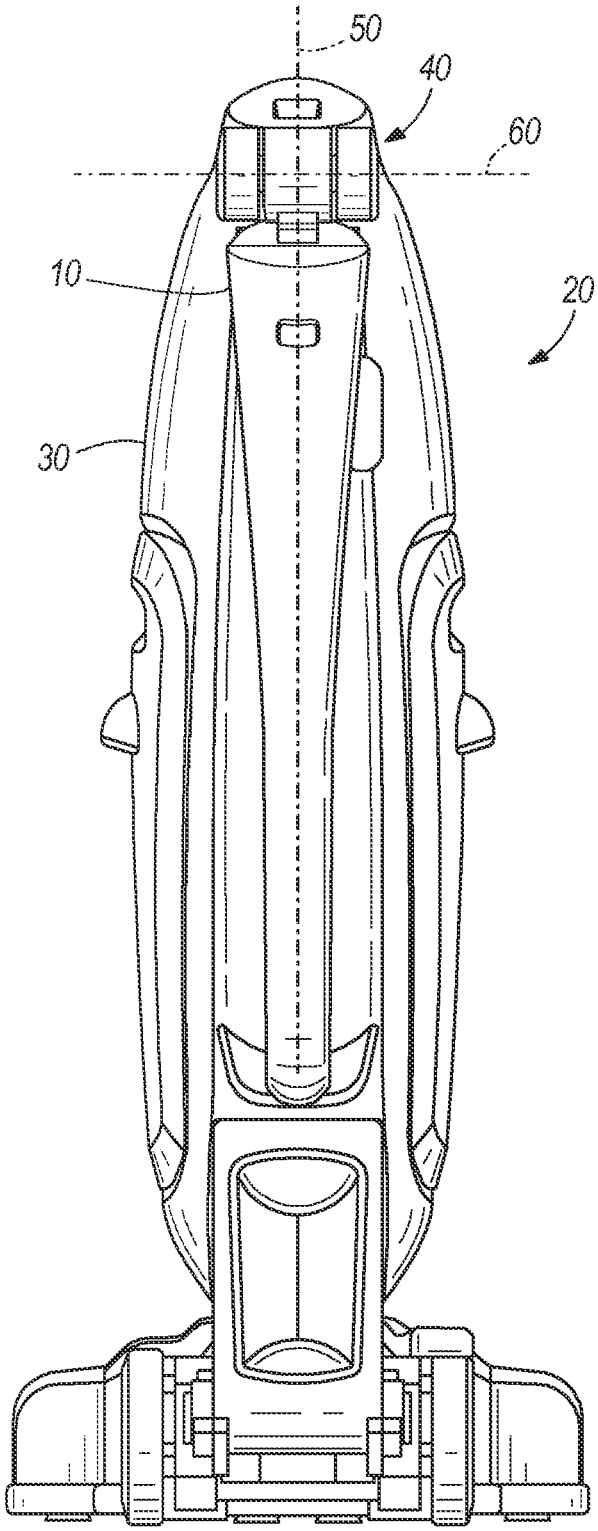
FIG. 3 PRIOR ART
FIG. 3 is a rear end view of a vacuum cleaner with the conventional handle of FIG. 1.

FIG. 1 is an enlarged partial perspective view of a conventional handle 10 for a cleaning device or upright-type vacuum cleaner 20. The handle 10 is coupled to the cleaner housing 30 at a pivot joint 40. A "handle" as used herein includes definitions that are generally known in the mechanical art, and may include a handgrip. For example, the handle 10 includes any structure that extends generally upwardly from the cleaner housing 30 that transfers forces caused by the operator to the cleaning device 20 to move the cleaning device 20 over a surface to be cleaned. Referring also to FIGS. 2 and 3, the cleaner housing 30 defines a centerline 50. The pivot joint 40 is configured to rotate the handle 10 about a pivot axis 60 that is perpendicular to the centerline 50. In both the operating (see FIG. 1) and the storage (see FIGS. 2 and 3) positions, the handle 10 extends substantially parallel to the centerline 50. For operating the vacuum cleaner 20, the handle 10 is rotated upwardly about the pivot axis 60 so that the handle 10 extends upwardly and away from the cleaner housing 30. As used herein, the terms "top," "bottom," "front," "rear," "side," "upwardly," "downwardly," and other directional terms are not intended to require any particular orientation, but are instead used for purposes of description only. For storing or stowing, the handle 10 is rotated downwardly. In this configuration, when viewed from a direction perpendicular to the centerline 50 (see FIG. 2), the handle 10 protrudes from the outer profile of the cleaner housing 30, thereby requiring additional space for storing the vacuum cleaner 20. Thus, there has developed a need for a mechanism that enables storing the vacuum cleaner in a compact footprint.

Figure 4:
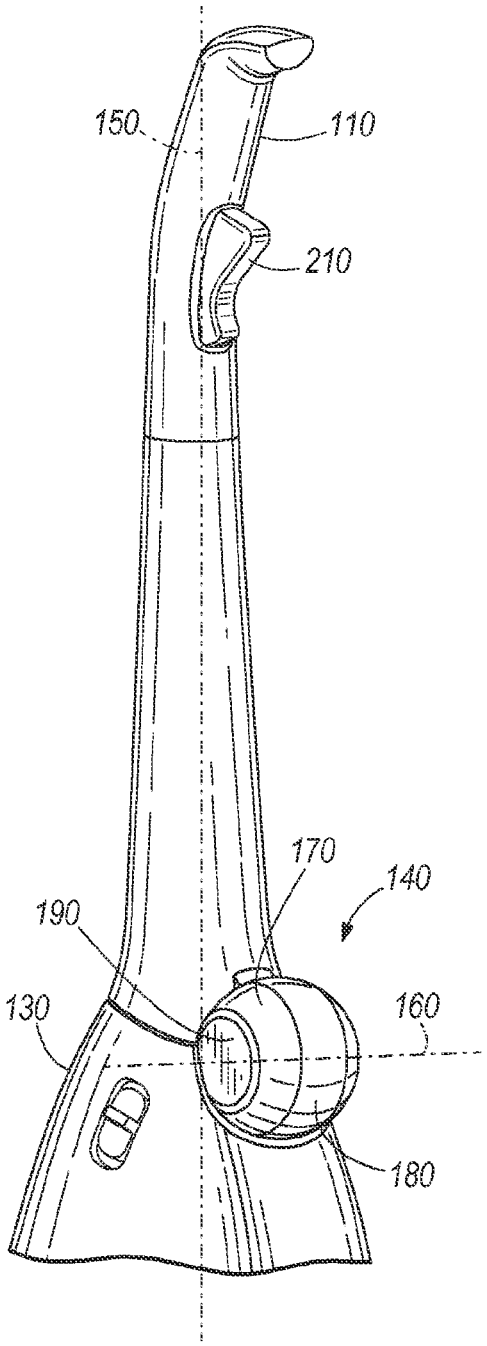
FIG. 4 is a perspective view illustrating a vacuum cleaner with a handle according to one embodiment of the invention.
Figure 5:
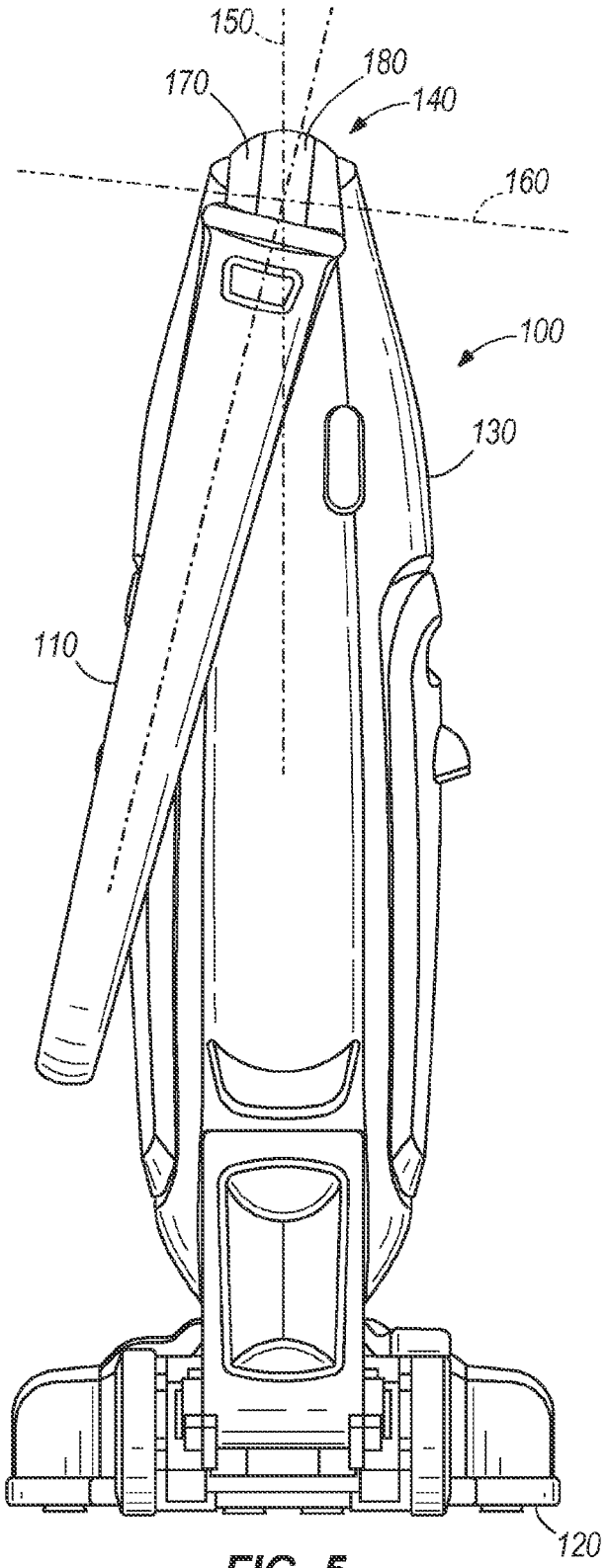
FIG. 5 is an end view of the vacuum cleaner of FIG. 4 illustrating the handle rotated to a storage position.
Figure 6:
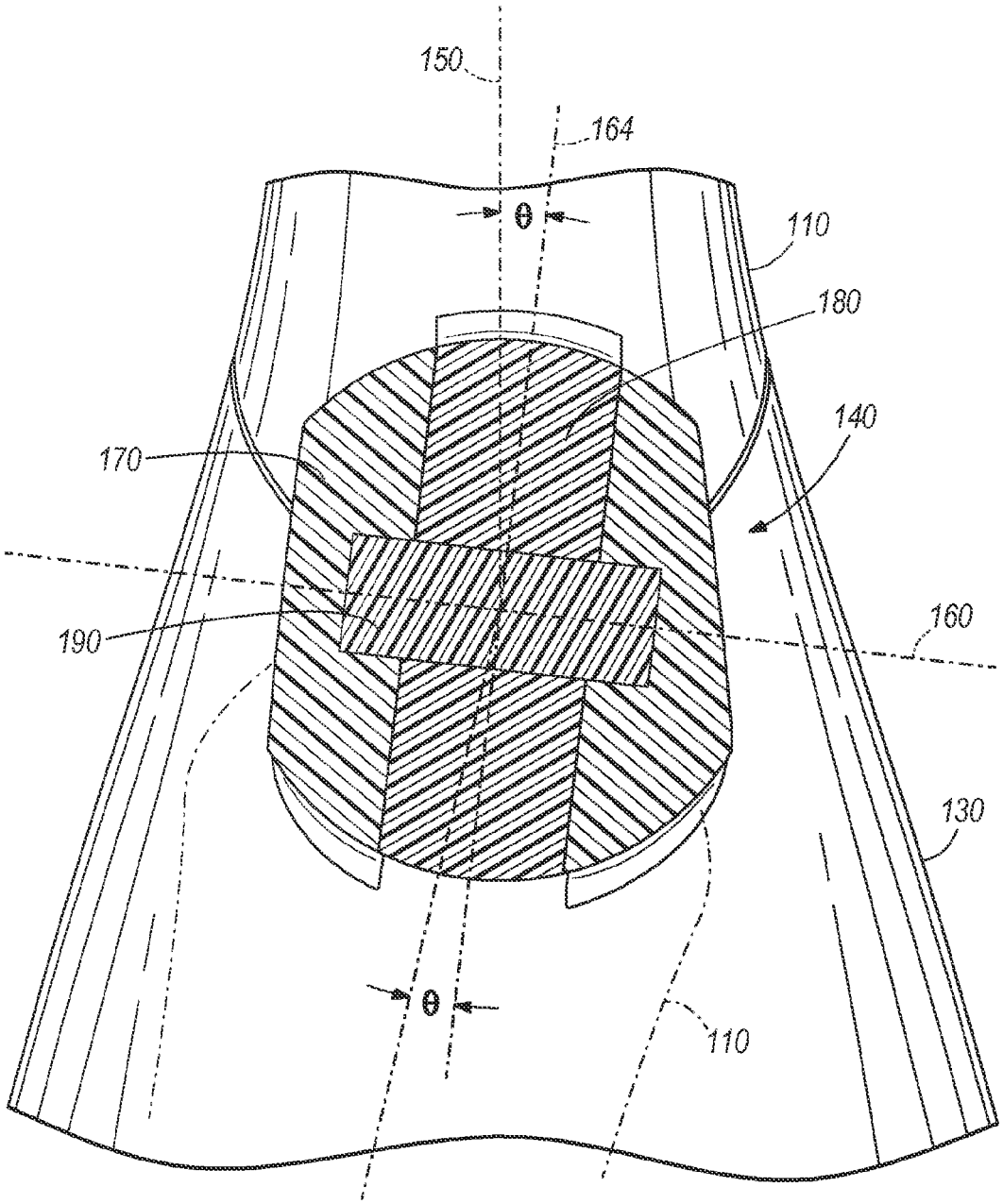
FIG. 6 is a cross-sectional view of the vacuum cleaner of FIG. 4, illustrating a pivot joint.

FIG. 4 illustrates a vacuum cleaner 100 with an elongate handle 110. Referring also to FIG. 5, the vacuum cleaner 100 includes a suction nozzle 120, a cleaner housing or body 130 connected to the suction nozzle 120, a suction generator (not shown) in the cleaner housing 130, and a dirt collection vessel (not shown) in the cleaner housing 130. The handle 110 is coupled to the cleaner housing 130 at a pivot or hinge joint 140. The cleaner housing 130 defines a central longitudinal axis or centerline 150. The pivot joint 140 is configured to rotate the handle 110 about a pivot axis 160 that is non-perpendicular to the longitudinal axis 150. Referring also to FIG. 6, the handle 110 extends non-perpendicular to the pivot axis 160. That is, the handle 110 is offset from an orientation 164 perpendicular to the pivot axis 160 at an acute angle θ. As such, when the handle 110 is folded downwardly, the handle 110 is rotated substantially conically about the pivot axis 160. In some embodiments, the pivot axis 160 is offset from an orientation perpendicular to the longitudinal axis 150 by approximately 5° to approximately 7°. In other embodiments, however, the pivot axis 160 may extend at other angles that are non-perpendicular to the longitudinal axis 150.

Figure 7:
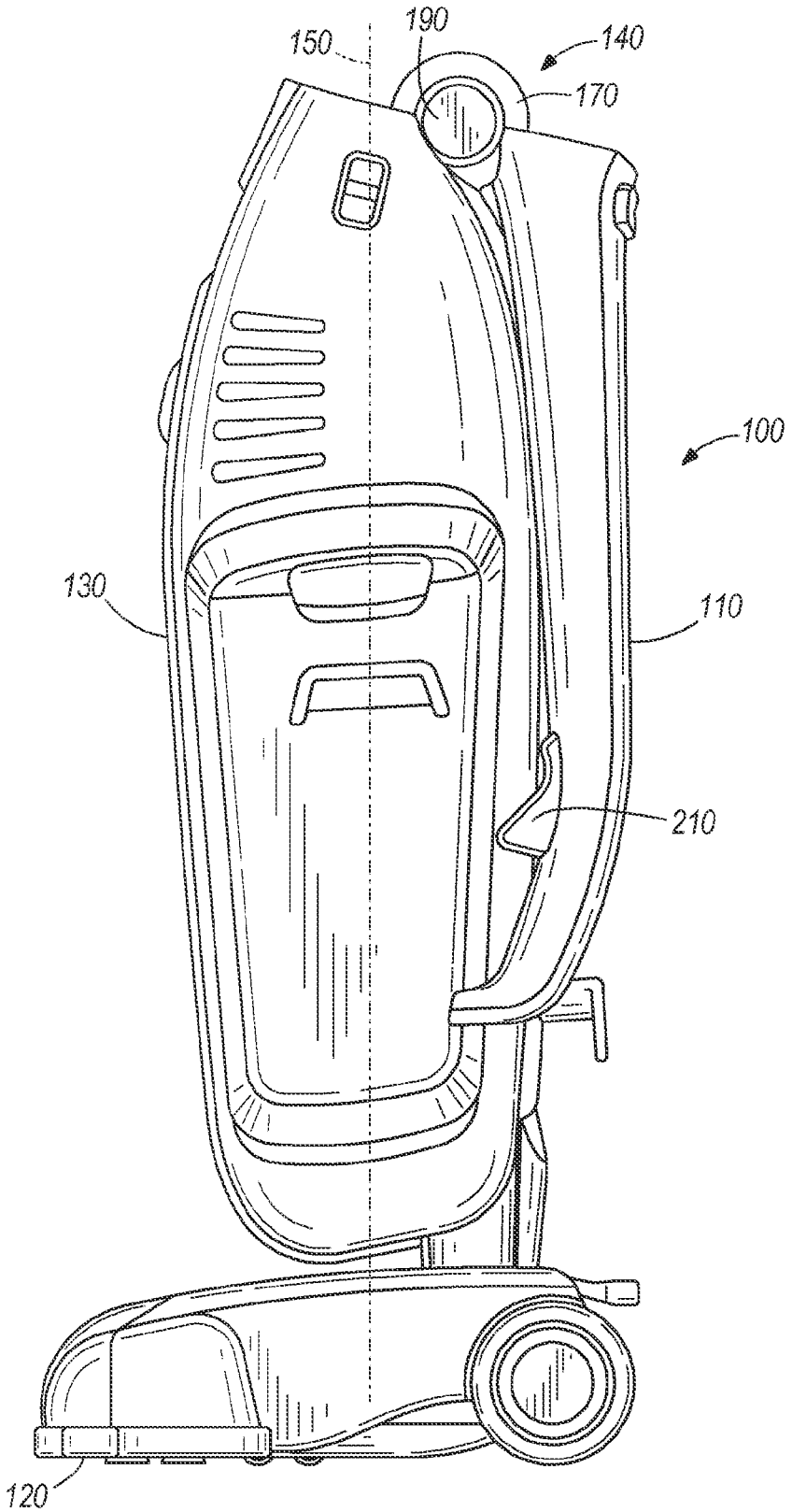
FIG. 7 is a side view of the vacuum cleaner of FIG. 4.
Figure 8:
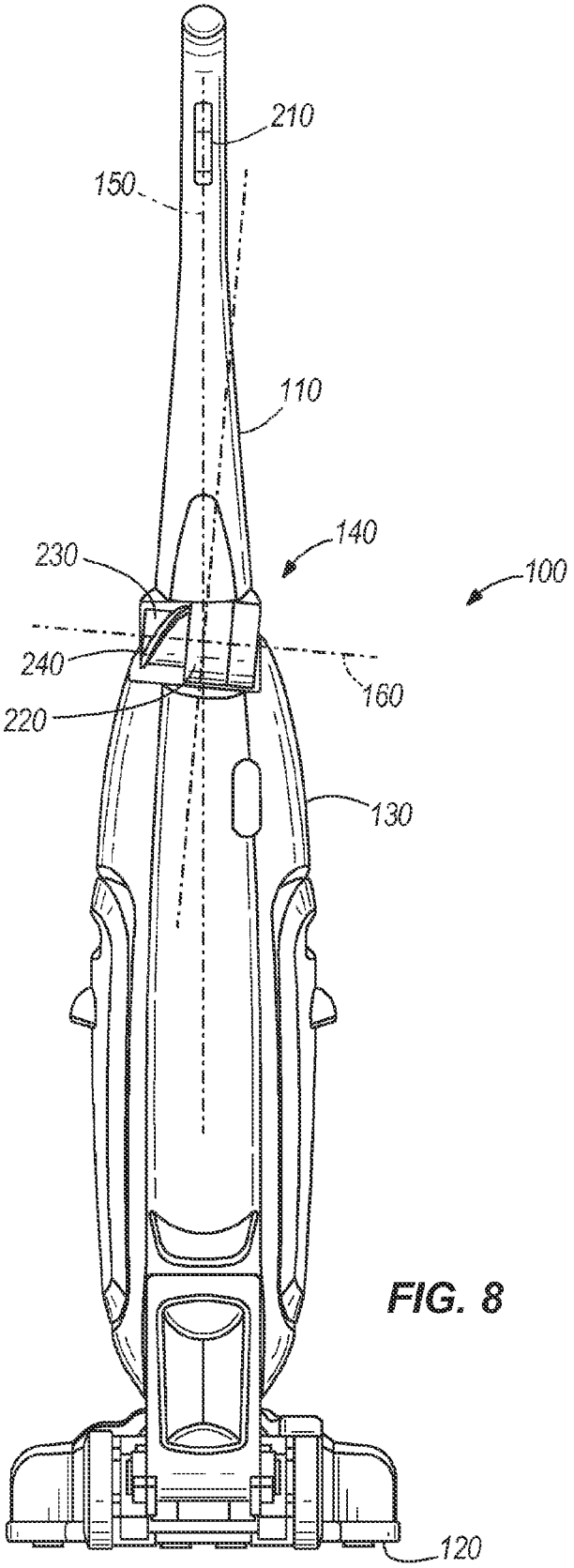
FIG. 8 is a rear end view of a vacuum cleaner with a handle according to another embodiment of the invention.
Figure 9:
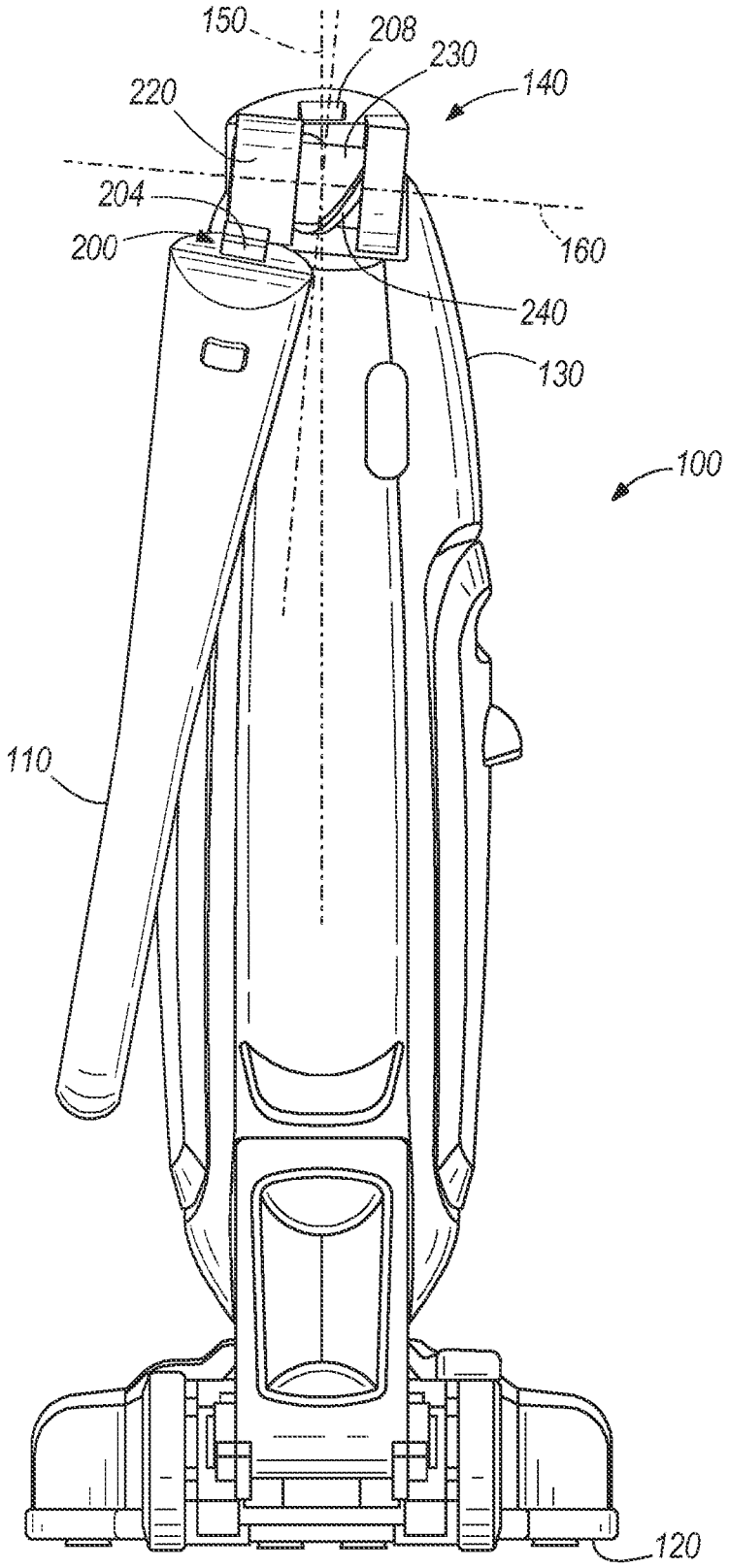
FIG. 9 is a rear end view of the vacuum cleaner of FIG. 8 illustrating the handle rotated to a storage position.

Referring also to FIG. 7, when the handle 110 is rotated or folded downwardly for storing or shipping, the handle 110 moves to a position adjacent to and offset from the cleaner housing 130 of the vacuum cleaner 100. In contrast to prior art configurations, the handle 110 does not substantially protrude from the outer profile or contour of the cleaner housing 130 when the handle 110 is rotated downwardly. As such, the vacuum cleaner 100 can be shipped or stored with the handle 110 in the folded position in a compact package without substantially increasing the footprint of the product compared to prior art configurations.

In the illustrated embodiment, the pivot joint 140 includes a female member 170 coupled to the cleaner housing 130 and a male member 180 coupled to the handle 110. In other embodiments, however, the female member 170 can be coupled to the handle 110 and the male member 180 can be coupled to the cleaner housing 130. The male member 180 is positioned proximate the female member 170, and a pin 190 is insertable through the female and male members 170, 180 to couple the cleaner housing 130 and the handle 110 together. The female and male members 170, 180 are so dimensioned as to give a smooth substantially bulbous appearance when the pin 190 is inserted through the female and male members 170, 180.

Although in the illustrated embodiment only a single male member 180 on the handle 110 and only a single female member 170 on the cleaner housing 130 are shown, in further embodiments, the handle 110 may include one or more male members 180, one or more female members 170, or a combination thereof. Similarly, the cleaner housing 130 may also include one or more female members 170, one or more male members 180, or a combination thereof. The pivot joint 140 thus suitably includes one or more female and male members 170, 180. Moreover, although FIGS. 4-6 illustrate the female and male members 170, 180 as integrally formed with the cleaner housing 130 and handle 110, respectively, in other embodiments the female and male members 170, 180 may be separately formed and attached to a respective one of the cleaner housing 130 and handle 110 via glue or fasteners.

Figure 11:
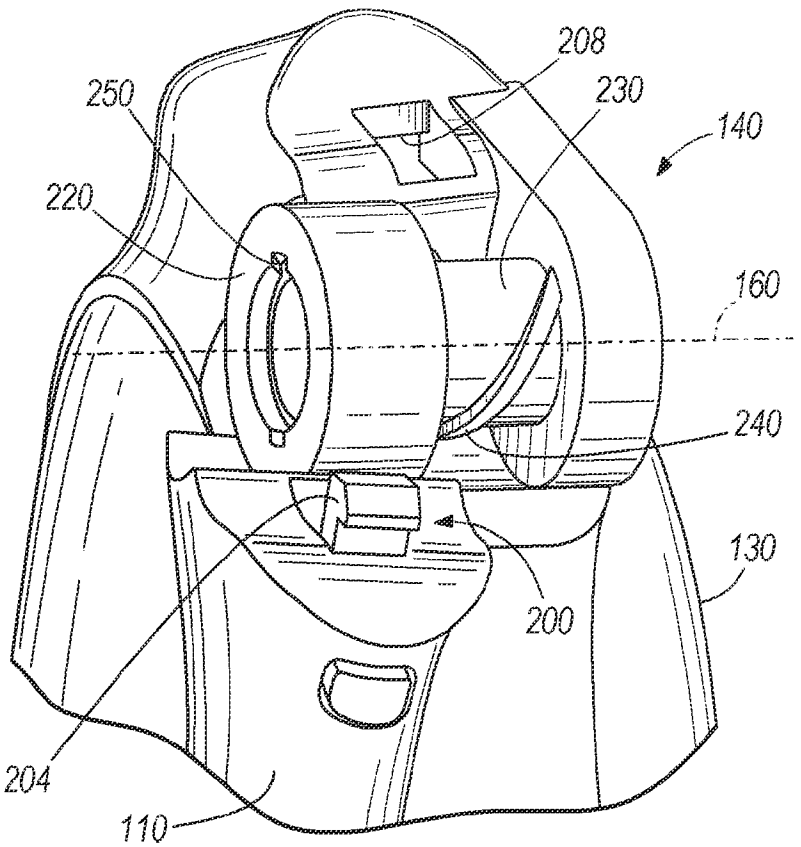
FIG. 11 is an enlarged partial perspective view of the handle of FIG. 8.
Figure 10:
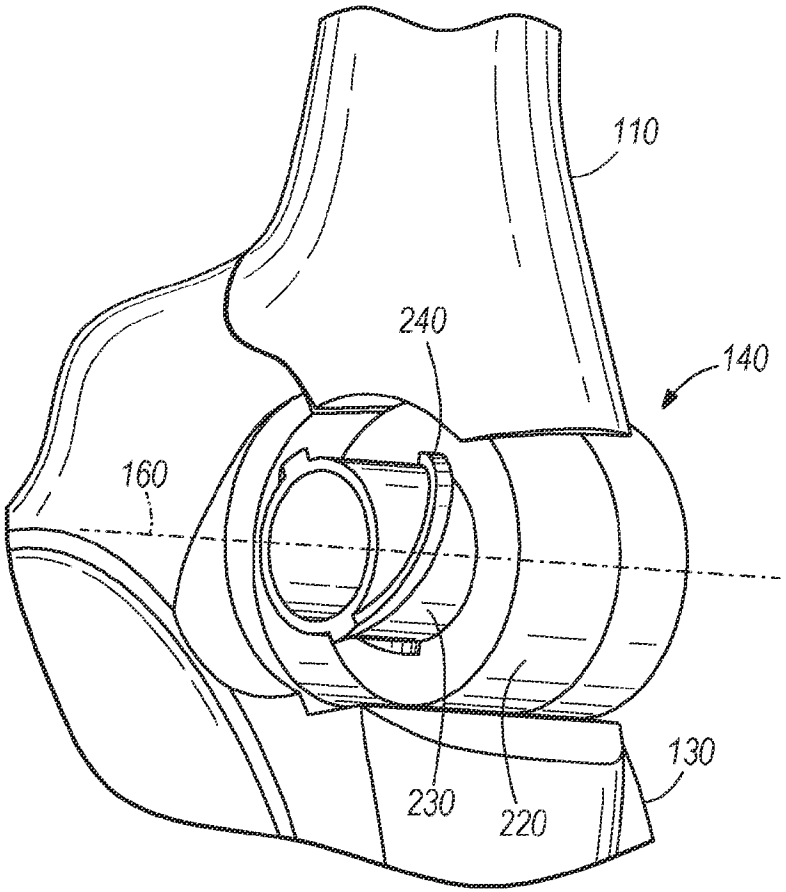
FIG. 10 is an enlarged partial perspective view of the handle of FIG. 8.

In some embodiments, the vacuum cleaner 100 includes a locking unit 200, which includes a detent 204 and a corresponding catch mechanism 208 (not shown in FIGS. 4-7; see, e.g., FIG. 11) between the cleaner housing 130 and the handle 110, and a release member 210 connected to the detent 204. The locking unit 200 is configured to releasably lock the handle 110 solely in a position substantially parallel to the longitudinal axis 150, i.e., the operating position. The release member 210 may be spring-loaded or biased by any other suitable mechanisms. The detent is selectively movable between a locked position where the detent 204 contacts the corresponding catch mechanism 208, and an unlocked position where the detent 204 is released out of the locking position. When the user rotates the handle 110 upwardly from the storage position toward the operating position, the detent 204 contacts the catch mechanisms 208 and locks the handle 110 so that the handle 110 fixedly extends upwardly and away from the cleaner housing 130. When the user depresses the release member 210 against the bias toward the handle 110, the detent 204 is released out of the locking position, thereby enabling the handle 110 to rotate or fold downwardly toward the storage position.

The surface cleaning device 100 is a vacuum cleaner adapted to clean a variety of surfaces, such as carpets, hardwood floors, tiles, or the like. More specifically, the illustrated surface cleaning device 100 is an upright wet vacuum cleaner capable of drawing in air and dirt such as liquid and debris. In alternative embodiments, the surface cleaning device 100 may not be a wet vacuum cleaner. Rather, the surface cleaning device 100 may be a dry vacuum cleaner capable of drawing in air and dirt such as dry debris. Alternatively, the surface cleaning device 100 may be an extractor capable of both dispensing liquid and drawing in air and dirt such as liquid and debris. In yet other embodiments, the surface cleaning device 100 may be a steam cleaner that dispenses liquid or steam but does not include a suction source. In still other embodiments, the surface cleaning device 100 may be a stick vacuum that does not include the brush rolls of other traditional upright cleaners. In additional embodiments, surface cleaning device 100 may be a sweeper that includes a handle and a pivoting base that supports a wet or dry cloth that is positioned below the base. These sweepers do not dispense liquid and do not include a suction source.

FIGS. 8-11 illustrate the vacuum cleaner 100 including a pivot joint 140 according to another embodiment of the invention. Like parts are identified using like reference numerals. The pivot joint 140 in this embodiment is configured to rotate the handle 110 about the pivot axis 160, and also to translate the handle 110 along the pivot axis 160. In the illustrated embodiment, the pivot axis 160 is non-perpendicular to the longitudinal axis 150 so as to store or stow the handle 110 at an orientation offset from the longitudinal axis 150. In other embodiments, however, the pivot axis 160 can be perpendicular to the longitudinal axis 150. As such, the handle 110 can be stored or stowed at a position that is linearly, but not angularly, offset from the longitudinal axis 150.

The pivot joint 140 includes a female member 220 coupled to the handle 110 and a male member 230 coupled to the cleaner housing 130. The male member 230 is received into the female member 220 to couple the cleaner housing 130 and the handle 110 together. In the illustrated embodiment, the male member 230 includes a projection or thread 240, and the female member 220 includes a groove 250 that corresponds to the projection 240. In some embodiments, the projection 240 extends helically about the pivot axis 160. The projection 240 and the groove cooperate together to translate the handle 110 along the pivot axis 160. That is, when viewed from the rear in a direction substantially perpendicular to the longitudinal axis 150, the handle 110 is translated generally from right to left along the pivot axis 160 as the handle 110 is rotated from the operating position (see FIGS. 8 and 10) to the storage position (see FIGS. 9 and 11). In other embodiments, the male member 230 may include the groove 250 and the female member 220 may include the projection 240. In still other embodiments, the female member 220 may be coupled to the cleaner housing 130 and the male member 230 may be coupled to the handle 110.

Although the invention has been described in detail with reference to certain preferred embodiments, variations and modifications exist within the scope and spirit of one or more independent aspects of the invention as described.

The invention claimed is:

1. A surface cleaning device comprising:

a base including a suction nozzle, the base defines a front edge positioned adjacent the suction nozzle, a back edge opposite the front edge, a first side surface extending between the front edge and the back edge;

a cleaner housing pivotally coupled to the base, the cleaner housing defining longitudinal axis; and a handle movably coupled to the cleaner housing such that the handle is movable relative to the cleaner housing from an operating position downwardly to a storage position, wherein as the handle moves from the operating position to the storage position, the handle moves away from the longitudinal axis and toward the first side surface.

2. The surface cleaning device of claim 1, wherein the handle pivots relative to the cleaner housing about a pivot axis.

3. The surface cleaning device of claim 2, wherein the pivot axis is non-perpendicular to the longitudinal axis.

4. The surface cleaning device of claim 2, wherein the handle linearly translates parallel to the pivot axis as the handle moves from the operating position to the storage position.

5. The surface cleaning device of claim 4, wherein the handle is substantially parallel with the longitudinal axis when the handle is in the operating position and the storage position.

6. The surface cleaning device of claim 4, wherein the pivot axis is non-perpendicular to the longitudinal axis.

7. The surface cleaning device of claim 1, further comprising a locking mechanism to selectively lock the handle in the operating position.

8. A surface cleaning device comprising:

a base including a suction nozzle;

a cleaner housing pivotally coupled to the base, the cleaner housing defining a longitudinal axis;

a handle moveably coupled to the cleaner housing such that the handle is movable relative to the cleaner housing from an operating position downwardly to a storage position, wherein the handle is substantially centered on the longitudinal axis when the handle is in the operating position, and wherein the handle is offset from the longitudinal axis when the handle is in the storage position.

9. The surface cleaning device of claim 8, wherein the handle pivots relative to the cleaner housing about a pivot axis.

10. The surface cleaning device of claim 9, wherein the pivot axis is non-perpendicular to the longitudinal axis.

11. The surface cleaning device of claim 9, wherein the handle linearly translates parallel to the pivot axis as the handle moves from the operating position to the storage position.

12. The surface cleaning device of claim 11, wherein the handle is substantially parallel with the longitudinal axis when the handle is in the storage position.

13. The surface cleaning device of claim 11, wherein the pivot axis is non-perpendicular to the longitudinal axis.

14. The surface cleaning device of claim 8, further comprising a locking mechanism to selectively lock the handle in the operating position.

15. A surface cleaning device comprising:

a base including a suction nozzle, the base defines a front edge positioned adjacent the suction nozzle, a back edge opposite the front edge, a first side surface extending between the front edge and the back edge;

a cleaner housing pivotally coupled to the base, the cleaner housing defining longitudinal axis; and a handle movably coupled to the cleaner housing such that the handle is movable relative to the cleaner housing from an operating position to a storage position, wherein when the handle is in the storage position, the handle extends downwardly toward the first side surface of the base and away from the longitudinal axis.

16. The surface cleaning device of claim 15, wherein the handle pivots relative to the cleaner housing about a pivot axis.

17. The surface cleaning device of claim 16, wherein the pivot axis is non-perpendicular to the longitudinal axis.

18. The surface cleaning device of claim 16, wherein the handle linearly translates parallel to the pivot axis as the handle moves from the operating position to the storage position.

19. The surface cleaning device of claim 18, wherein the handle is substantially parallel with the longitudinal axis when the handle is in the storage position.

20. The surface cleaning device of claim 18, wherein the pivot axis is non-perpendicular to the longitudinal axis.

* * * * *